US010323364B2

(12) United States Patent
Cochran

(10) Patent No.: US 10,323,364 B2
(45) Date of Patent: Jun. 18, 2019

(54) ASPHALT MILLING CUTTER ARRANGEMENTS

(71) Applicant: Coneqtec Corp., Wichita, KS (US)

(72) Inventor: Gary L. Cochran, Colwich, KS (US)

(73) Assignee: Coneqtec Corp., Wichita, KS (US)

( * ) Notice: Subject to any disclaimer, the term of this patent is extended or adjusted under 35 U.S.C. 154(b) by 0 days.

(21) Appl. No.: 15/705,987

(22) Filed: Sep. 15, 2017

(65) Prior Publication Data

US 2019/0085515 A1 Mar. 21, 2019

(51) Int. Cl.

| | |
|---|---|
| ***E01C 23/08*** | (2006.01) |
| ***E01C 23/088*** | (2006.01) |
| ***E01C 23/09*** | (2006.01) |
| *E02F 3/96* | (2006.01) |

(52) U.S. Cl.

CPC ..... *E01C 23/088* (2013.01); *E01C 23/09* (2013.01); *E02F 3/96* (2013.01)

(58) Field of Classification Search

CPC ..... E01C 23/088; E01C 23/127

See application file for complete search history.

(56) References Cited

U.S. PATENT DOCUMENTS

| | | | | |
|---|---|---|---|---|
| 2,139,306 | A | 12/1938 | Gaffney | |
| 3,156,231 | A | 11/1964 | Harding, Jr. | |
| 4,340,256 | A | 7/1982 | Hart | |
| 4,697,850 | A | 10/1987 | Tuneblom | |
| 4,714,294 | A | 12/1987 | Swan | |
| 4,720,207 | A | 1/1988 | Salani | |
| 4,725,097 | A | 2/1988 | Zelenka | |
| 5,052,757 | A | 10/1991 | Latham | |
| 5,083,839 | A | 1/1992 | Younger | |
| 5,722,789 | A | 3/1998 | Murray et al. | |
| 5,791,737 | A * | 8/1998 | Cochran | E01C 23/088 299/39.8 |
| 6,033,031 | A | 3/2000 | Campbell | |
| 6,547,484 | B2 | 4/2003 | Murphy | |
| 6,626,499 | B1 | 9/2003 | Schenk et al. | |
| 6,779,850 | B1 | 8/2004 | Schibeci et al. | |
| 6,832,818 | B2 | 12/2004 | Luciano | |
| 7,066,555 | B2 | 6/2006 | Hansen et al. | |
| 7,810,888 | B2 | 10/2010 | Clark et al. | |
| 2014/0327294 | A1 | 11/2014 | Johnson et al. | |
| 2016/0263774 | A1 | 9/2016 | Runquist et al. | |

FOREIGN PATENT DOCUMENTS

| | | | | |
|---|---|---|---|---|
| EP | 0245810 | A2 * | 11/1987 | B28D 1/186 |

* cited by examiner

*Primary Examiner* — Janine M Kreck

(74) *Attorney, Agent, or Firm* — Woodard, Emhardt, Henry, Reeves & Wagner, LLP; Charles Meyer

(57) ABSTRACT

The present disclosure relates to grinders in the form of a planer or drum grinder for milling surfaces such as asphalt or concrete. The planer has a multiplicity of cutters oriented in selected arrangements. It is described in the context of a representative system that is added to prime movers, such as skid-steer loaders.

14 Claims, 5 Drawing Sheets

ASPHALT MILLING CUTTER ARRANGEMENTS

FIELD OF THE DISCLOSURE

The present disclosure relates to grinders in the form of a planer or drum grinder for milling surfaces such as asphalt or concrete. The planer has a multiplicity of cutters or grinding teeth oriented in selected arrangements. It is described in the context of a representative system that is added to prime movers, such as skid-steer loaders.

BACKGROUND

In normal use, a skid-steer loader has a loader bucket pivotally attached to two front lift arms. Optionally, the loader bucket of a skid-steer loader may be removed and alternate or auxiliary implements such as a planer may be attached to grind and remove hard surfaces such as pavement surfaces of concrete or asphalt such as in roads, bridges or parking lots. Such planers are sometimes called cold planers.

Common apparatus for grinding or planing away hard level surfaces such as asphalt roads or concrete roads commonly drive a rotating grinding cylinder or drum, the exterior surface of the drum has a multiplicity of cutters for grinding and cutting, typically teeth or carbide or diamond tipped cutters. The cutters can be replaced as they wear out. Such a grinding drum is commonly driven and controlled by a hydraulic machine which provides supporting and driving mechanisms for pressing the grinding drum against a flat surface to be ground or planed away, for rotatably driving the grinding drum causing its cutters to impinge upon the surface to be ground away, and for moving the grinding drum in a forward motion along the surface being ground. Typically, a cold planing apparatus incorporates a protective shroud to shield against flying debris.

In many cases, a surface planer is used to remove an area of material at a constant depth. In one version of the prior art, illustrated in FIG. 2A, a grinder arrangement 50 is configured with a series of circular plates 52 vertically arranged and perpendicular relative to a shaft or axle. A series of cutters 54 such as grinding teeth are supported by and arranged around the perimeter of the plates. The plates 52 have a constant diameter. The cutting width of each plate is limited by the orientation of cutters 54. For example, each plate may only be able to cut a width of 1½ to 2 inches. When used, as illustrated in FIG. 2B, grinder arrangement 50 forms a cutting pattern formed as a single continuous slot 55 at an even depth. To form a continuous slot 55, the paths of respective cutters 54 of adjacent plates 52 must be closely spaced and/or overlap to avoid leaving a grooved surface. However, the plate spacing is limited due to the physical mounting arrangement. The maximum width is also limited because power and mounting requirements limit the number of plates 52 which can be used. Further, a drawback or disadvantage of such grinding drums is that pulverized asphalt or concrete debris tends to pile up in front of and behind the grinding drum as it moves forward, creating unwanted resistance to forward motion and drum rotation, wasting energy and causing excess wear by re-grinding of the debris.

An improvement on grinder 50 with vertical plates is the elliptical disc arrangement disclosed in U.S. Pat. No. 5,791,737. An example is illustrated in FIG. 3A. The elliptical disc grinder arrangement 60 includes an axle having four elliptical grinding discs 62 mounted thereon. A multiplicity of hardened grinding teeth or cutters 64 are spaced at intervals along the outer peripheral surfaces of the elliptical discs.

The elliptical plates 62 are tilted and fixed with respect to the axle. An elliptical plate 62 can be angled so that the path of its perimeter defines a cylindrical section relative to a shaft. When viewed along the axis of the shaft, the ellipse appears to be a circle. When such an elliptical plate is rotated about the shaft axis, all points on the ellipse edges orbit equidistant from the axis and the rotation defines a cylindrical section with a height and radius. The cutter paths all have the same radius around the axis of rotation, but may be offset laterally along the axis thus determining the cylindrical section height. The paths may be closely spaced or may overlap while the cutters are spaced in different spots along a shared orbit. This creates a continuous slot 65 of even depth (FIG. 3B). The tilted elliptical plates 62 allow a wider path to cut by each plate and its associated cutters. For example, each plate may cut a pattern in a width of 4 to 6 inches. The plate and cutter spacing also allows pulverized debris to pass between the plates to exit the grinder.

SUMMARY

Example embodiments include planers which may include shafts, plates and cutter arranged in specific orientations to obtain specialty cutting patterns. The arrangements may include angled elliptical plates defining cylindrical radii of different sizes. In some arrangements, the elliptical plates are arranged in combination with circular vertical plates. The planer can be mounted on a skid steer loader or similar support vehicle. The arrangements can be selected to form specific cutting patterns in a surface being ground, for example by an operator for the support vehicle.

In one embodiment, a planer for milling a surface includes a shaft to be moved over a surface to be ground in a direction of travel. At least one first elliptical plate is fixedly arranged in a non-perpendicular angle relative to the axis of rotation and carrying a set of cutters arranged so that as the shaft rotates, the cutters each orbit in a circle of constant radius around the axis of rotation defining a first circular cylindrical section with a first cylindrical radius. At least one second plate is also fixedly arranged on the shaft and carries a second set of cutters arranged so that as the shaft rotates about its axis of rotation the grinding teeth orbit circularly around the axis of rotation defining a second radius. The second radius differs from the first radius.

In some embodiments, the second plate is an elliptical plate. In alternate embodiments, the second plate may be a vertical circular plate. In one arrangement, a plurality of first elliptical plates and a plurality of second plates are arranged in an alternating pattern. In an alternate, arrangement, a plurality of first elliptical plates is arranged on opposing sides of a single second plate.

Some embodiments incorporate at least a third plate fixedly arranged on the shaft carrying a third set of cutters defining a third radius. The third radius is different from the first radius and the second radius.

Certain embodiments provide a planer for milling a surface including a shaft rotatably mounted along an axis of rotation. A first set of cutters is supported on the shaft and arranged in an angled elliptical pattern so that as the shaft rotates, the cutters each orbit in a circle at a first cylindrical radius around the axis of rotation. A second set of cutters is also supported on the shaft and arranged so that as the shaft rotates about its axis of rotation the cutters orbit circularly at a second radius around the axis of rotation. The second radius differs from the first radius. In some embodiments, the second set of cutters is arranged in an angled elliptical pattern relative to the axis of rotation. Alternately, the second set of cutters is arranged in a circular pattern perpendicular to the axis of rotation.

In further embodiments, a planer for milling a surface includes a shaft rotatably mounted along an axis of rotation. At least one angled plate is mounted with an apex portion coaxially aligned with the shaft. The plate includes a pair of portions angled in a concave arrangement diverging from the apex on opposing sides of the shaft. A set of cutters is arranged on the plate so that as the shaft rotates, each cutter orbits in a circle of constant radius around the axis of rotation and within a plane perpendicular to the axis of rotation. At least a first cutter on the plate is in a first vertical plane and defines a first radius, and at least a second cutter on the plate is in a second vertical plane and defines a second radius. The second radius is different from the first radius. In some embodiments, the cutters are arranged in a pattern extending from said apex along said angled portions, wherein the cutters are progressively spaced to define paths of increasing radii to make a substantially continuous angled cut.

Further forms, objects, features, aspects, benefits, advantages, and examples of the present disclosure will become apparent from a detailed description and drawings provided herewith.

DESCRIPTION OF SELECTED EXAMPLES

Figure 1:
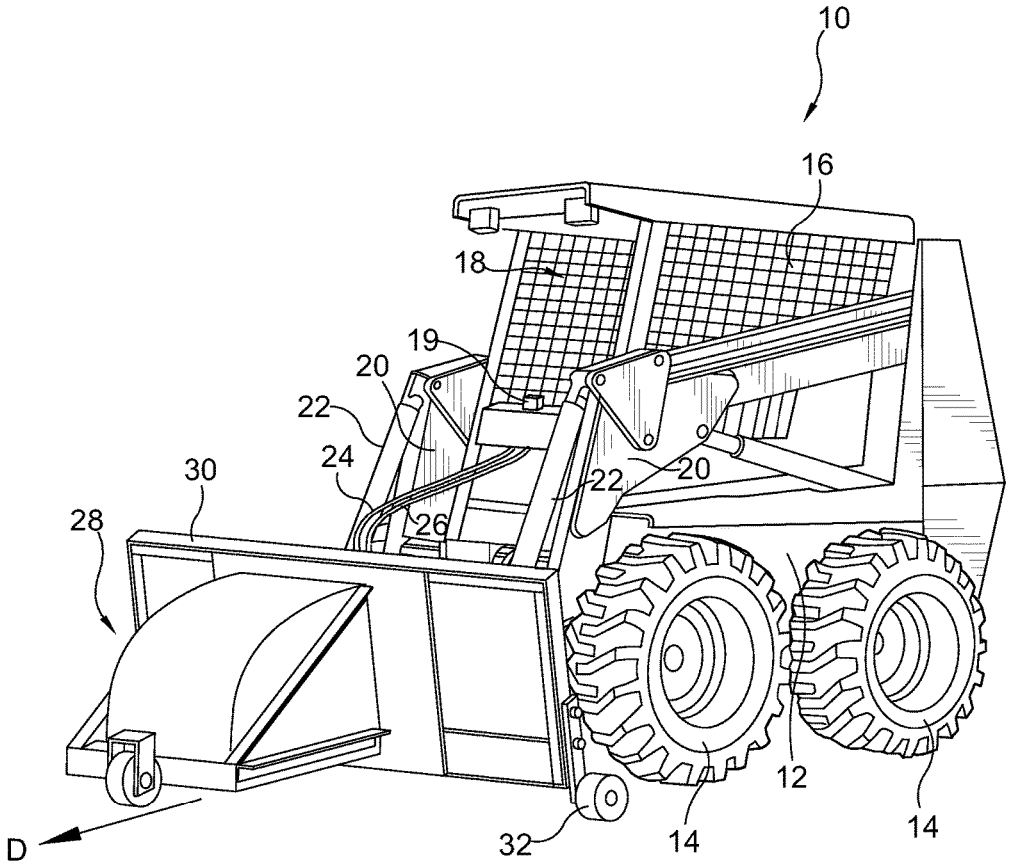
FIG. 1 is a front perspective view of a representative arrangement with a grinder unit attached to a skid-steer loader.

For the purpose of promoting an understanding of the principles of the disclosure, reference will now be made to the examples illustrated in the drawings and specific language will be used to describe the same. It will nevertheless be understood that no limitation of the scope of the disclosure is thereby intended. Any alterations and further modifications in the described examples, and any further applications of the principles of the disclosure as described herein are contemplated as would normally occur to one skilled in the art to which the disclosure relates. Certain examples of the disclosure are shown in detail; although it will be apparent to those skilled in the relevant art that some features which are not relevant to the present disclosure may not be shown for the sake of clarity.

Example embodiments include planers which may include shafts, plates and cutter arranged in specific orientations to obtain specialty cutting patterns. The arrangements may include angled elliptical plates defining cylindrical radii of different sizes. In some arrangements, the elliptical plates are arranged in combination with circular vertical plates. The planer can be mounted on a skid steer loader or similar support vehicle. The arrangements can be selected to form specific cutting patterns in a surface being ground, for example by an operator for the support vehicle.

Referring generally to FIG. 1 there is shown a skid steer loader as an example support vehicle with a representative planer 28. A typical skid steer loader 10 is a type of support vehicle having a frame 12, four wheels 14 or tracks, an operator position, such as a cage or cab 16 with a seat 18, and a pair of left and right front lift arms 20. Left and right hydraulic cylinders 22 may be paired with lift arms 20. Various work tool implements may be interchangeably mounted to the skid steer loader, for example by being coupled and uncoupled from the lift arms 20.

As illustrated, an implement frame 30 is generally configured to be mounted to the left and right arms 20 of the skid steer loader and optionally the left and right hydraulic cylinders 22. In a preferred embodiment, brackets are provided at the rear of the frame allowing the frame and planer apparatus 28 to be attached to the lift arms 20 and/or cylinders 22. Left and right arms 20 and the left and right hydraulic cylinders 22 may function in concert to pivot the orientation of frame 30 and the planer. In a preferred embodiment, frame 30 is configured as a lateral piece, which may function as a debris shield and which may allow the planer to be mounted or moved to the left or right of the centerline of the skid-steer loader in the direction of travel D if desired. Optionally ground engaging elements such as rollers 32 are mounted adjacent the foot of the frame 30 to allow the frame to rest upon and roll over a support surface.

The skid-steer loader 10 may have a hydraulic power system, which may be selectively coupled directly or through an interface to certain work implements to provide hydraulic power to the implements. Example supply and return lines 24, 26 are shown. Generally the skid steer loader and any work implements are controlled by an operator through a control 19 located adjacent the operator position. In some skid steer loaders, the operator enters the operator position from the front of the vehicle.

In certain embodiments, a planer 28 is based on a grinder with grinding teeth known as cutters. The cutters are arranged around a rotatable shaft, for example on plates and located within a housing or shield which is level or angled and configured to move at a uniform height along or above a surface in a direction of travel. As the planer is moved, the cutters mill or grind the surface. The arrangement of plates and cutters along the axis within the grinder is sometimes called the grinding drum. Preferably, hydraulic power is supplied to rotate the shaft so that the cutters or teeth cut into the surface at a desired depth. The grinding drum shaft may be supported parallel to the surface for even cutting, or it may be angled if an angled cut profile is desired. The grinding drum is hydraulically driven by separate or shared hydraulic lines (not shown).

The planer may be mounted on a host machine, such as via a frame to a skid-steer loader, or it may operate independently, for example when mounted to an independent frame or trolley. The support vehicle, frame and/or the side plates are used independently or in cooperation to control the grinding depth of the planer. In certain embodiments, the planer housing is mounted to a support frame which supports the housing at a desired height to control the grinding depth of the grinding drum and which is movable to move the housing and grinding drum along the surface to be ground in the direction of travel D.

Figure 3A:
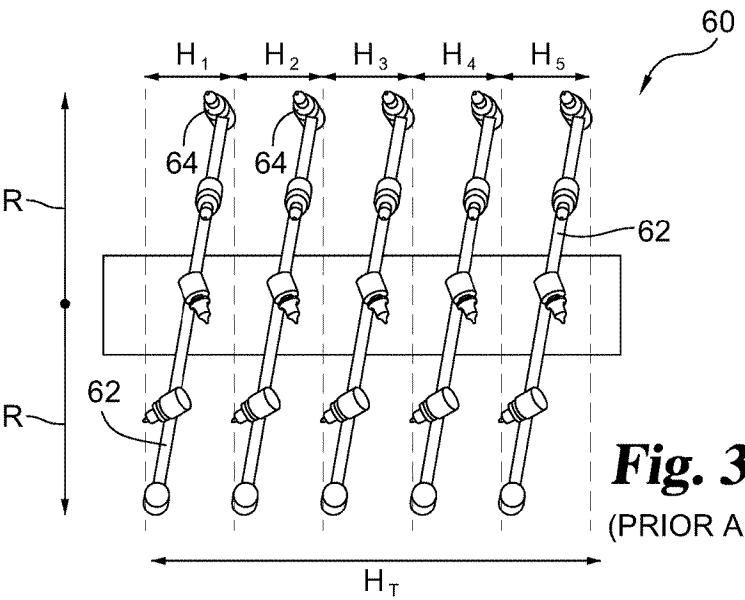
Fig. 3A (PRIOR ART)
FIG. 3A is a front view of a prior art cutter arrangement.
Figure 3B:
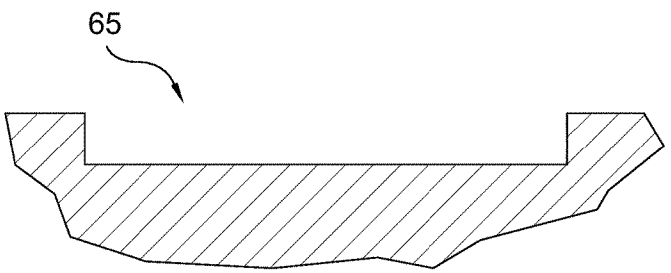
Fig. 3B (PRIOR ART)
FIG. 3B illustrates the cutting pattern formed by the cutter arrangement in FIG. 3A.
Figure 2A:
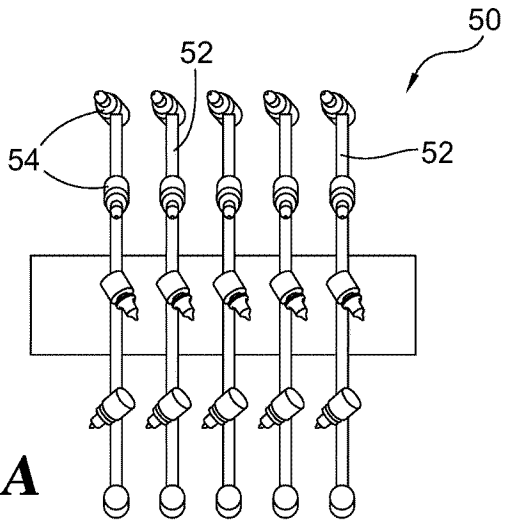
Fig. 2A (PRIOR ART)
FIG. 2A is a front view of a prior art cutter arrangement.
Figure 2B:
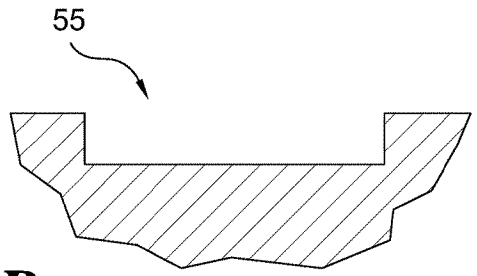
Fig. 2B (PRIOR ART)
FIG. 2B illustrates the cutting pattern formed by the cutter arrangement in FIG. 2A.

Selected disclosed cutter arrangements are improvements on a circular vertical cutter arrangement as illustrated in FIG. 2A or an elliptical cutter arrangement as illustrated in FIG. 3A and discussed in U.S. Pat. No. 5,791,737. In summary, FIG. 3A illustrates a cutter arrangement 60 with an axial shaft and a series of tilted elliptical plates 62 mounted to the shaft. Each elliptical plate has a pair of long radii. A series of cutters 64 are mounted around the perimeter of each plate. When appropriately angled, the perimeters of the elliptical plates form sections of a cylinder of constant radius R. When viewed along the rotational axis of the shaft, the elliptical plates are perceived as circular. The cutters are supported at the same radius and orbit around the axis of rotation but are offset laterally along the axis. The plates 62 are angled along the major axis of the ellipse. The plates can be angled in either direction relative to the shaft. When rotated, the cutter arrangement of each plate 62 cuts a cylindrical section with a constant radius R and with a respective cylindrical section height $H_1$, $H_2$, $H_3$, $H_4$ defined by the axial offset of the plate ends along the shaft. The cylindrical total height $H_T$ of arrangement 62 correspondingly defines a cut width measured along the length of the shaft. Consequently a wider cutting pattern 65 (FIG. 3B) can be achieved with an elliptical plate cutter arrangement 60 than the relatively narrow cutting pattern 55 that can be obtained by a vertical plate cutter arrangement 50 (FIG. 2B).

Planer 28 in FIG. 1 is representative. The present disclosure teaches cutter arrangements, such as arrangements 110, 210, 310, 410, and 510, any one of which can be arranged on the shaft within the housing of planer 28. In alternate embodiments, portions or variations of the cutter arrangements can be arranged in various permutations.

Figure 4A:
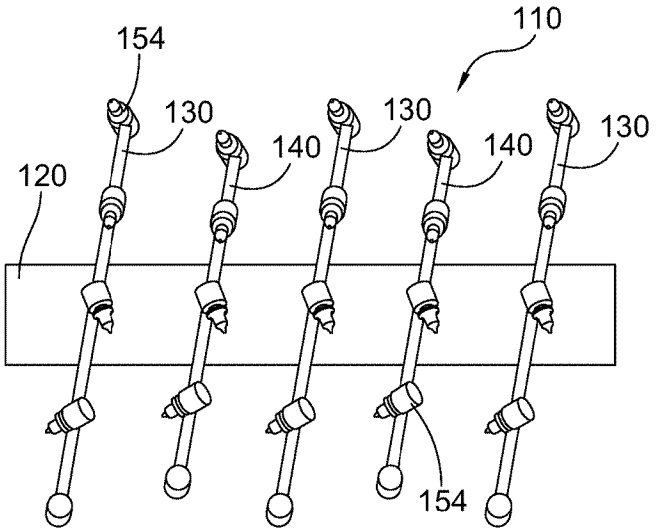
FIG. 4A is a front view of an embodiment of a cutter arrangement.
Figure 4B:
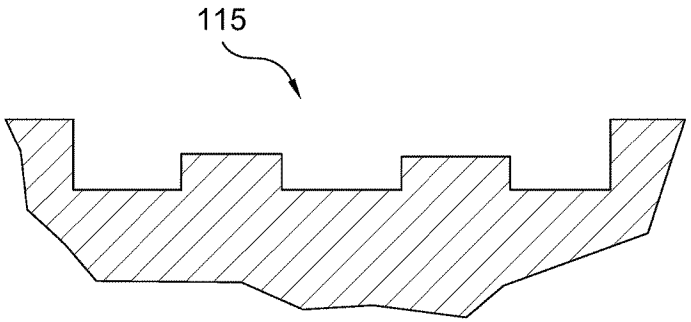
FIG. 4B illustrates the cutting pattern formed by the cutter arrangement in FIG. 4A.

FIG. 4A illustrates a cutter arrangement 110 with at least one and in this case five elliptical angled plates mounted on shaft 120. Each plate includes a series of cutters 154 mounted around the perimeter of the plate. Arrangement 110 includes alternating angled elliptical plates 130, 140. The cylindrical radius of plates 130 differs from the cylindrical radius of plates 140. Correspondingly, plates 130 and 140 form cylindrical sections of greater and lesser radius. Arrangement 110 creates a cut pattern 115 (FIG. 4B) with a series of alternating upward and downward stepped portions forming a crenelated or notched pattern.

In certain uses, the crenelated cut pattern 115 provides advantages. For example a crenelated pattern may be advantageous when milling a portion of a surface to repair an area containing cracks. A repair process can be performed by first using a planer with plate arrangement 110 to grind cut pattern 115 into the surface, thereby removing a volume of material as debris. The volume of the removed area is then filled with a replacement material such as concrete or asphalt, which may be pressed into place, for example by rolling or stamping, and allowed to cure. Ideally, the new material bonds with the old material at the material interfaces to form a seal. As one advantage, the crenelated cut pattern 115 increases the contact surface area between the old milled surface and the replacement material. The increased contact area allows increased adhesion between the two materials. The alternating up and down stepped profile also creates a mechanical barrier or lock so that the replacement material is less likely to creep relative to the old material due to pressure or due to expansion or contraction based on ambient temperature variations. Another advantage is that the path for water infiltration is greatly increased over a straight narrow cut, reducing the risk of degradation due to freezing and thawing.

Figure 5A:
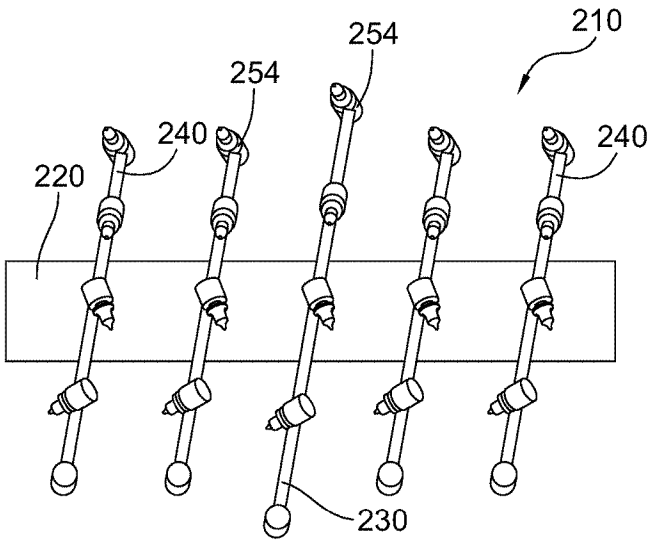
FIG. 5A is a front view of an embodiment of a cutter arrangement.
Figure 5B:
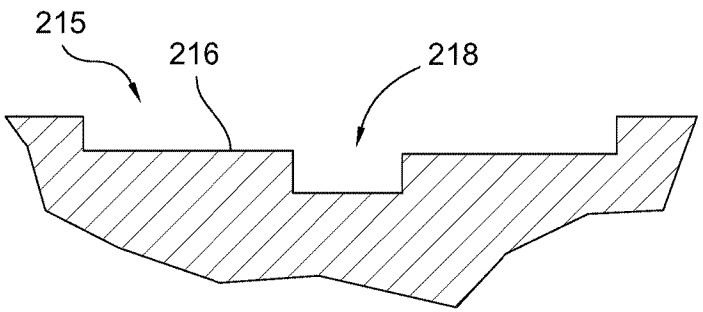
FIG. 5B illustrates the cutting pattern formed by the cutter arrangement in FIG. 5A.

In an alternate embodiment, FIG. 5A illustrates a cutter arrangement 210 along shaft 220 with several angled elliptical plates 240 and cutters 254 defining smaller cylindrical radius arrangements on opposing sides of an angled central elliptical plate 230 defining a larger cylindrical radius. The arrangement creates a T cut pattern 215 (FIG. 5B). The T cut pattern includes a pair of parallel sections 216 at a relatively shallow depth with a width defined by the axial displacement of cutters 254 along plates 240. The central plate 230 creates a central deeper section 218 with a width defined by the axial displacement of the cutters 254 along the axis of plate 230. Arrangement 210 can also be used during a process of repairing cracks in the pavement. The T cut pattern increases the surface area of adhesion between the original material and replacement material, and may allow greater mass of material to be used with a deeper portion to help anchor the replacement material in place. The stepped pattern also distributes the traffic load over the repaired portion over a wider area. Another advantage of a T cut pattern is that the path for water infiltration is greatly increased over a straight narrow cut, reducing future degradation due to freezing and thawing.

Figure 6A:
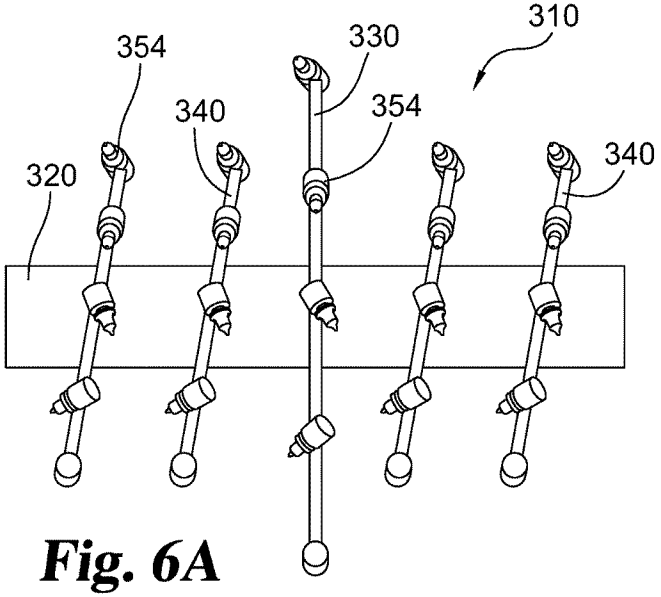
FIG. 6A is a front view of an embodiment of a cutter arrangement.

As a variation of a T cut profile, FIG. 6A shows a cutter arrangement 310 with cutters 354 supported on a series of angled elliptical plates and a circular vertical plate along shaft 320. The plates include a series of elliptical plates 340 defining smaller cylindrical radius arrangements on opposing sides of a central vertical plate 330 with a circular radius larger than the cylindrical radius of plates 340.

Figure 6B:
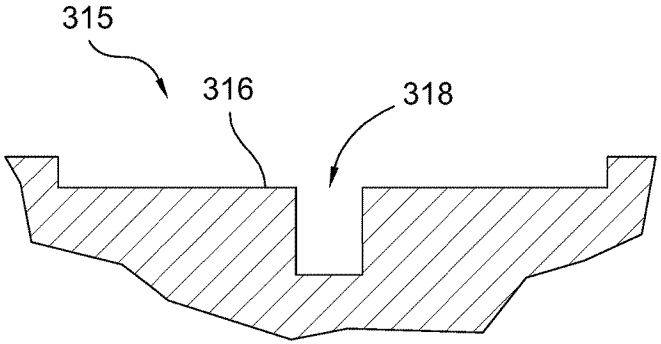
FIG. 6B illustrates the cutting pattern formed by the cutter arrangement in FIG. 6A.

Arrangement 310 creates a cut pattern 315 (FIG. 6B) with a slot cut profile. The pattern 315 includes a pair of parallel sections 316 at a relatively shallow depth with a width defined by the axial displacement of the cutters 354 along plates 340. The central plate 330 creates a central slot cut 318 with a relatively thin width yet significantly greater depth corresponding to the cutters on plate 330.

In an exemplary use, arrangement 310 can be used as trenching tool during fiber optic cable installation. Currently a microtrencher is often used when installing fiber optic cables in streets and other areas of asphalt. A microtrencher typically makes a narrow ½ inch to 2½ inch straight sided cut. The cut is filled after a cable is placed in the cut. Currently there is no standard width or depth of this cut with each community making its own specification. When arrangement 310 is used, the illustrated slot cut 318 creates a narrow slot or trench with straight sides. A cable can be placed in a protected position within slot 318 and then covered by replacement material to fill pattern 315. Cut pattern 315 can be used to assist in cable installation and also has the advantages discussed with respect to cut pattern 215 discussed above. In alternate embodiments, a vertical circular plate 330 can be used with other arrangements, such as those illustrated in arrangements 110. 210, 410 or 510, to add a slot cut feature to the respective cut pattern. One or more vertical plates to make slot cuts can be used to place slots at either end or desired mid points in the cut pattern.

Figure 7A:
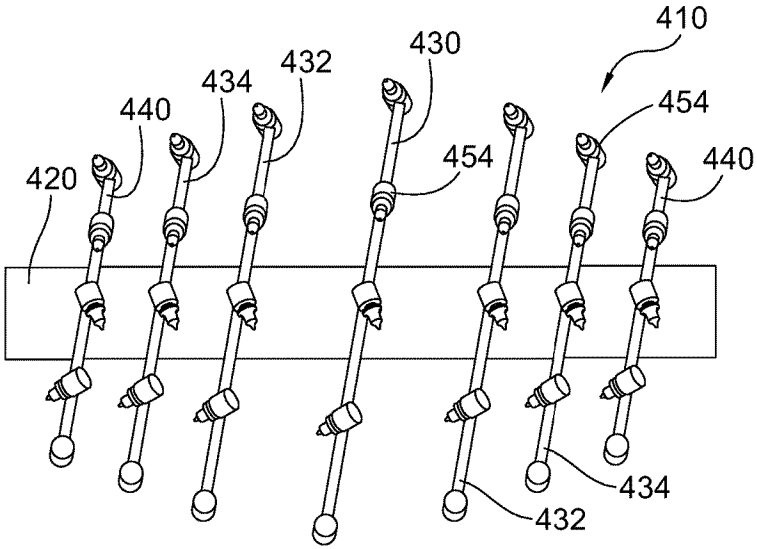
FIG. 7A is a front view of an embodiment of a cutter arrangement.
Figure 7B:
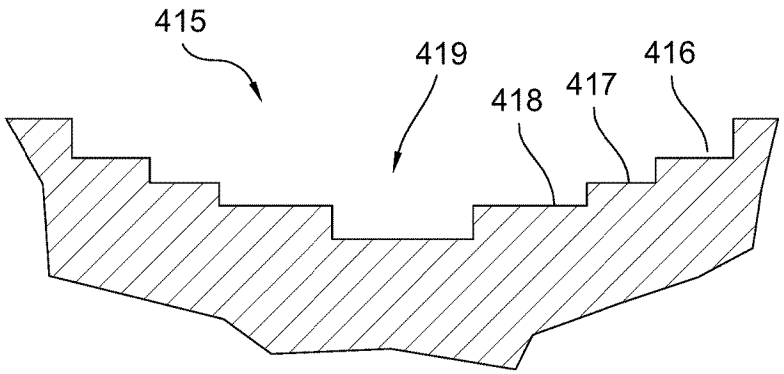
FIG. 7B illustrates the cutting pattern formed by the cutter arrangement in FIG. 7A.

In an alternate embodiment, FIG. 7A illustrates cutter arrangement 410 with a series of angled elliptical plates with different cylindrical radii in stepped diameters along shaft 420. In the example illustrated, arrangement 410 includes a plates 440 defining smaller cylindrical radii adjacent opposing ends of shaft 420. A series of plates 434, 432 of increasing cylindrical radii converge towards a central plate 430. Central plate 430 defines the largest cylindrical radius. Correspondingly, the cut pattern 415 of cutters 454 forms a stepped series of cuts with the depths increasing from the opposing ends toward the center. Outer steps 416 are the shallowest, with steps 417, 418 increasing in depth to the deepest step 419. This creates a stepped V-cut pattern. The V-cut pattern can be useful in various contexts and also has advantages of greater surface area, lower water infiltration, greater mass and resistant to creep as discussed above. In alternate embodiments, the series of plates can have larger radius cut patterns at the ends converging to a smaller central radius, or the plates can be arranged in an increasing or decreasing series across the shaft to form a series of increasing or decreasing depth steps. In still further embodiments, a series of plates in multiple diameters can be arranged in various permutations to arrange desired asymmetric and/or customized patterns of shallower, deeper and interim depth steps.

Figure 9:
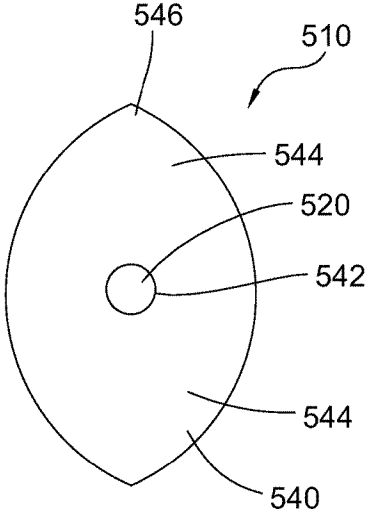
FIG. 9 is a side view of the cutter arrangement of FIG. 8A.
Figure 8A:
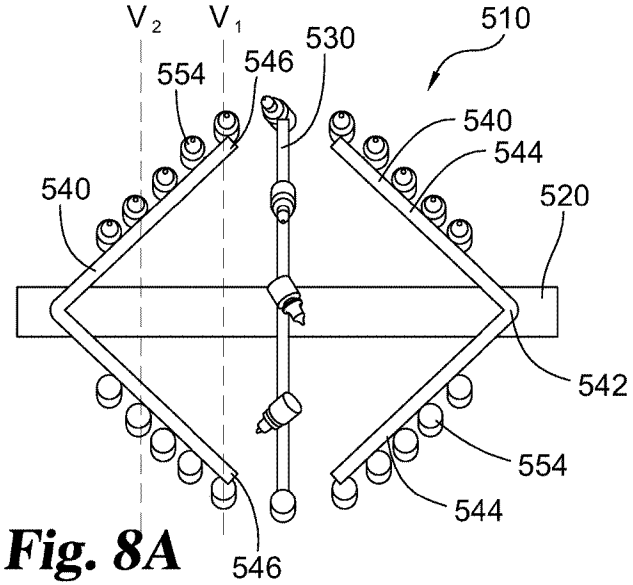
FIG. 8A is a front view of an embodiment of a cutter arrangement.
Figure 8B:
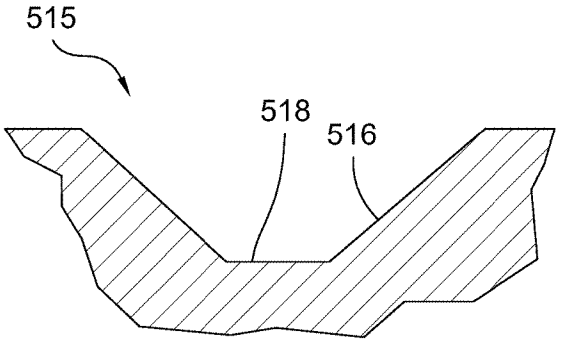
FIG. 8B illustrates the cutting pattern formed by the cutter arrangement in FIG. 8A.

FIGS. 8A and 9A show cutter arrangement 510 with a central plate and a pair of angled plates along shaft 520. Central plate 530 is vertical and creates the deepest or apex portion of cut pattern 515 (FIG. 8B). Alternately, central plate 530 could be an elliptical plate angled to define a cut pattern of a desired width. Angled plates 540 are bent or curved and arranged on opposing sides of central plate 530 with concave portions facing plate 530. Each plate 540 includes a central vertex 542 mounted to and aligned with shaft 520. A pair of angled portions 544 diverge horizontally and upward/downward from vertex 542. The angled portions may be linear or curved. From the perspective of FIG. 8A, angled portions 544 have surfaces or faces which diverge upward and downward and also extend laterally inward to tip portions 546 with a maximum radius approximately matching the radius of central plate 530. As illustrated from an end view in FIG. 9, bent plates 540 are also vertically tapered to tip portions 546; forming somewhat triangular shaped upper and lower portions with two curved edges.

The cutters 554 on each V-plate are arranged in a pattern extending inward from each vertex 542 along a corresponding angled portion 544 toward the middle with increasing cylindrical radii around the axle. The upper and lower angled portions 544 are continuous as they extend inward. Accordingly, for example, cutters 554 each orbit in a circle of constant radius yet a first cutter in vertical plane $V_1$, has a first radius which is different from a second radius defined by a second cutter in vertical plane $V_2$. Angled portions 544 provide four edges in each vertical or perpendicular plane. Cutters 554 can be placed on different plate edges within the same vertical plane with closely adjacent and/or overlapping paths.

A progressive arrangement of cutters 554 with increasing and decreasing orbits in arrangement 510 creates a substantially continuous and relatively smooth and sloped pattern cut, for example creating V-cut pattern 515. V-cut pattern 515 includes a pair of angled sides 516 extending to a deepest portion 518. In one arrangement the cutters 554 in each geometric perpendicular plane are of the same radius. Alternately, a pattern of cutters within a shared perpendicular plane, for example along four edges in plane $V_2$, may be angled inward and outward in an alternating pattern, with the outward angled cutters having a slightly smaller orbit radius.

While the disclosure has been illustrated and described in detail in the drawings and foregoing description, the same is to be considered as illustrative and not restrictive in character, it being understood that only the preferred example has been shown and described and that all changes, equivalents, and modifications that come within the spirit of the disclosures defined by following claims are desired to be protected.

The invention claimed is:

1. A planer for milling a surface, comprising:

a. a rotatable shaft to be moved over a surface to be ground in a direction of travel and defining an axis of rotation;

b. a plurality of first elliptical plates each fixedly arranged in a non-perpendicular angle relative to the axis of rotation and each carrying a set of cutters arranged so that as the shaft rotates, the cutters each orbit in a circle of constant radius around the axis of rotation defining a first circular cylindrical section with a first cylindrical radius;

c. a second plate fixedly arranged on said shaft, wherein said second plate is circular and arranged perpendicular to the axis of rotation and carrying a second set of cutters arranged so that as the shaft rotates the second set of cutters each orbit circularly around the axis of rotation defining a second radius; and, d. wherein said plurality of first elliptical plates is arranged on opposing sides of said second plate and wherein the second radius is significantly greater than the the first radius and configured so that the second plate cuts a slot with a relatively thin width yet significantly greater depth than the cuts made by the plurality of first elliptical plates.

2. The planer of claim 1, wherein the second plate cuts a straight sided slot with a width between ½ inch and 2½ inches.

3. The planer of claim 1, wherein the second plate cuts a slot at the middle of the cut pattern made by the plurality of first plates.

4. A planer for milling a surface, comprising:

a. a rotatable shaft to be moved over a surface to be ground in a direction of travel and defining an axis of rotation;

b. two sets of first cutters supported on said shaft at a first cylindrical radius and arranged in an angled elliptical pattern so that as the shaft rotates, the first cutters each orbit in a circle around the axis of rotation;

c. a set of second cutters supported on said shaft at a second radius and arranged in an angled elliptical pattern so that as the shaft rotates about its axis of rotation the second cutters orbit circularly around the axis of rotation; and, d. wherein the set of second cutters is arranged between said two sets of first cutters and wherein the second radius is less than the first radius so that the two sets of first cutters and the set of second cutters form an alternating pattern with the set of second cutters cutting an upward stepped portion between downward stepped portions cut by the two sets of first cutters.

5. The planer of claim 4, comprising at least a set of third cutters supported on said shaft and arranged so that as the shaft rotates about the axis of rotation the third cutters orbit circularly around the axis of rotation defining a third radius;

wherein the third radius is significantly greater than the first radius and the second radius so that the set of third cutters cuts a central slot with a relatively thin width yet significantly greater depth than the first cutters and the second cutters.

6. The planer of claim 4, wherein each set of first cutters is arranged on a respective elliptical plate fixedly arranged to the rotatable shaft and wherein the set of second cutters is arranged on an elliptical plate fixedly arranged to the rotatable shaft.

7. The planer of claim 4, comprising:

at least three sets of the first cutters supported on the shaft at the first radius;

at least two sets of the second cutters supported on the shaft at the second radius; and, wherein the sets of first cutters and the sets of second cutters are arranged in an alternating pattern to cut a series of alternating upward and downward stepped portions forming a crenelated pattern.

8. The planer of claim 4, comprising:

a plurality of sets of first cutters at the first radius;

a plurality of sets of second cutters at the second radius; and, wherein the sets of first cutters and the sets of second cutters are arranged in an alternating pattern to cut a series of alternating upward and downward stepped portions forming a crenelated pattern.

9. A planer for milling a surface, comprising:

a. a rotatable shaft to be moved over a surface to be ground in a direction of travel and defining an axis of rotation;

b. at least one angled plate with an apex portion coaxially aligned with said shaft, and with a pair of portions angled in a concave arrangement diverging from said apex on opposing sides of said shaft;

c. a set of cutters arranged on said plate so that as the shaft rotates, each cutter orbits in a circle of constant radius around the axis of rotation and within a plane perpendicular to said axis of rotation; and, d. wherein at least a first cutter on said plate is in a first vertical plane and defines a first radius, wherein at least a second cutter on said plate is in a second vertical plane and defines a second radius and wherein the second radius is different from the first radius.

10. The planer of claim 9, comprising a second plate supporting a set of cutters.

11. The planer of claim 10, wherein said second plate is a circular plate arranged perpendicular to the axis of rotation.

12. The planer of claim 10, wherein said second plate is a second angled plate with an apex portion coaxially aligned with said shaft, and with a pair of portions angled in a concave arrangement diverging from said apex on opposing sides of said shaft; wherein the set of cutters on said second plate is arranged so that each cutter orbits in a circle of constant radius around the axis of rotation and within a plane perpendicular to the axis of rotation; and, wherein at least a third cutter on said second plate is in a third vertical plane and defines a third radius, wherein at least a fourth cutter on said second plate is in a fourth vertical plane and defines a fourth radius and wherein the third radius is different from the fourth radius.

13. The planer of claim 12, wherein the concave aspect of said second plate faces the concave aspect of said first plate.

14. The planer of claim 9, wherein the cutters on said plate are arranged in a pattern extending from said apex along said angled portions, wherein said cutters are progressively spaced to define paths of increasing radii to make a substantially continuous angled cut.

* * * * *